US006203858B1

(12) United States Patent
Plomer

(10) Patent No.: US 6,203,858 B1
(45) Date of Patent: Mar. 20, 2001

(54) METHOD AND SYSTEM FOR COATING A WEB

(75) Inventor: Anton Plomer, Heidenheim (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 08/428,253

(22) PCT Filed: Aug. 11, 1995

(86) PCT No.: PCT/DE94/00933

§ 371 Date: Jun. 16, 1995

§ 102(e) Date: Jun. 16, 1995

(87) PCT Pub. No.: WO95/08026

PCT Pub. Date: Mar. 23, 1995

(30) Foreign Application Priority Data

Sep. 14, 1993 (DE) ..... 43 31 160

(51) Int. Cl.[7] ..... B05D 1/02

(52) U.S. Cl. ..... 427/425; 427/209; 427/294; 118/325; 118/316; 118/50.1

(58) Field of Search ..... 427/421, 424, 427/209, 356, 294, 425; 118/324, 325, 326, 50.1, 313, 315, 316

(56) References Cited

U.S. PATENT DOCUMENTS

| | | | | |
|---|---|---|---|---|
| 4,448,818 | * | 5/1984 | Hartog et al. | 118/326 |
| 4,944,960 | | 7/1990 | Sundholm et al. . | |
| 5,376,177 | * | 12/1994 | Elvidge et al. | 118/410 |
| 5,397,601 | * | 3/1995 | Korhonen | 118/410 |

FOREIGN PATENT DOCUMENTS

| | | | |
|---|---|---|---|
| 2 068 781 | | 12/1980 | (GB) . |
| 2 103 115 | | 7/1982 | (GB) . |
| 2103115 | * | 2/1983 | (GB) . |

* cited by examiner

*Primary Examiner*—Shrive Beck
*Assistant Examiner*—Bret B. Chen
(74) *Attorney, Agent, or Firm*—Taylor & Aust, P.C.

(57) ABSTRACT

The invention is directed to a process and system for coating a traveling material web, especially paper or cardboard, with at least one liquid medium, in which the coating medium is conveyed to an applicator device with a spray nozzle fitted in a vacuum chamber to generate a spray mist. The spray mist is applied to the material web according to the invention in that it is applied to the outside of at least one roll and transferred to the material web from the roll.

15 Claims, 2 Drawing Sheets

METHOD AND SYSTEM FOR COATING A WEB

BACKGROUND OF THE INVENTION

1. Field of the Invention

The invention relates to a method and system for coating a traveling material web, such as a paper web or cardboard web.

2. Description of the Related Art

Coating systems for paper and cardboard are variously known where, for instance according to GB 21 03 115 A, the transfer of coating mixture on the material web, from the shells of two coordinated rolls forming together a press gap, takes place in the press gap. Employed as an applicator system are nozzle applicators or dip rolls. For smoothing and dosing of the applied layer, the applicator system uses a doctor blade.

Known for the coating of traveling webs are also applicator systems which operate in the fashion of a curtain coater and where the uniformity and adhesion of the curtain coat is improved in that the system is preceded by a vacuum chamber arranged on the backing roll that carries the web. A curtain coating method employing a vacuum chamber is described in U.S. Pat. No. 3,735,729, which is not customarily used for paper webs. It serves primarily the coating of photographic paper, since the respective coating mixtures possess a high consistency. Considerable problems are encountered in the coating of paper webs with sizing, which have a very low consistency and viscosity.

All of these inventions are suited for the application of relatively large quantities of coating mixture per square meter ($m^2$) of web area. But they fail when an extremely low coating weight per $m^2$ is desired.

Known from EP 04 35 904 B1 is a method and a device for the coating of paper, cardboard or similar substrates that travel continuously along a path. The coating is transformed to a mist and fed to an applicator nozzle with an applicator surface. A vacuum chamber for pickup of surplus mist is arranged adjacent to the applicator surface. The spray mist created is by a "positive force" (pressure) and by means of the applicator nozzle applied directly on the substrate (paper web). With this method, too, it is doubtful whether an extremely low coating weight per $m^2$ can be applied on the paper web with the uniformity that is necessary for many paper grades.

Lastly, with so-called air knife systems it is also known to arrange the air knife setup in a large vacuum container. Here, however, the air knife does not apply a coating, but serves to scrape coating mixture off the web in order to dose it.

The problem underlying the invention is to provide an applicator system, or coating system, for traveling material webs involving very light, extremely thin coatings and nonetheless uniform amounts of coating, notably for the application of sizing.

SUMMARY OF THE INVENTION

The present invention provides a spray nozzle for producing a spray mist of coating mixture which is applied to the outside of at least one roll and transferred to the material web from the roll. The spraying of a liquid mixture as such is customary in many technical fields, but is not at all customary for the coating of traveling webs of paper or cardboard.

According to the invention, a coating that is both extremely thin and very uniform, notably also transverse to the direction of travel, is obtained by direct application; that is, spray mist is applied on a bare roll and picked up by the material web. The uniformity is inventionally obtained at the contact point between web and roll, where the web picks the thin liquid film up from the roll. The web may be carried by the roll with a certain tension, the web being deflected. Preference is given though to allowing the web to proceed through the press gap formed by the two rolls, which makes a double-sided coating possible.

The invention makes use of the vacuum chamber known from EP 04 35 904 B1, which is arranged around the spray nozzle. The vacuum chamber serves to suck up surplus coating mixture mist also in the present invention, but part of the mist can settle on the inside wall surface.

According to an important, further idea of the invention, a baffle is provided for part of the surplus spray mist, by arranging within the vacuum chamber a side wall beside the spray nozzle, on the departure side of the pertaining roll surface. The baffle (side wall) is preferably so fashioned, or enlarged, that it forms an inner chamber around the spray nozzle. In this chamber prevails a certain pressure, produced by the spray mist discharging from the spray nozzle.

The effect of the baffle (side wall or inner chamber) is, for one, that the spray mist proceeds better to the roll and, for another, a relief of the vacuum chamber which, similar to EP 04 35 904 B1, safeguards that coating mixture (spray mist) issuing out of the spray nozzle cannot escape from the chamber, that is, through the gap existing between the chamber and backing roll, into the surroundings. The air entering from the surrounding holds the spray mist back in the chamber, allowing it, in the invention, to settle partly on the baffle and partly on the inside wall of the outer chamber. An outlet allows the precipitated coating to drain. Precipitated mist remaining in the outer or inner chamber is passed, for instance by a suction blower, to a separator where the separated mixture and the mixture draining directly from the chamber can be fed to a common collection vessel for recycling.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, which show in.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
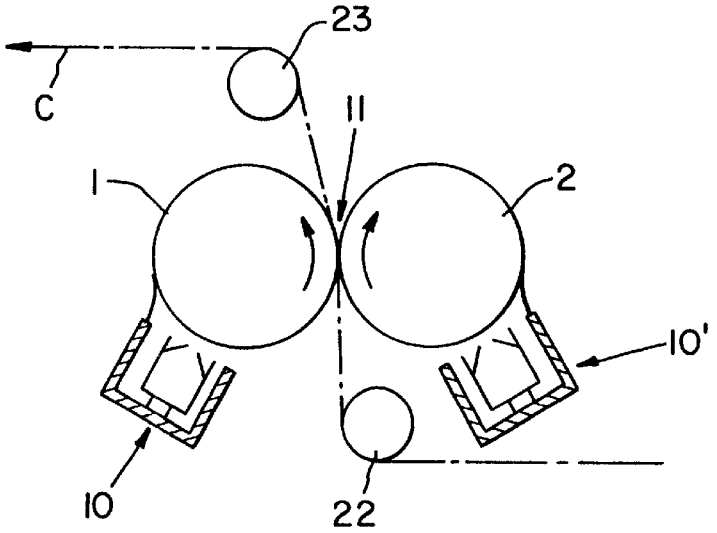
FIG. 1, a basic overall illustration.

Referring now to the drawings, and particularly to FIG. 1, web C is introduced in a gap 11 formed between two press rolls 1 and 2 and coated in gap 11. Guide rolls 22 and 23 are provided for correct tracking of the web. The applicators for the coating mixture are referenced 10 and 10' here and arranged essentially beneath the respective pertaining press roll 1, 2. Applicators 10, 10' extend substantially across the entire length of the press rolls.

It is to be understood that instead of using two press rolls 1 and 2 with one applicator 10 and 10' each for simultaneous coating of both sides of the web, it is also possible to use only a single coating roll with a single applicator 10 or 10', for coating only one side of the web, with a pertaining backing roll associated with the coating roll.

Figure 2:
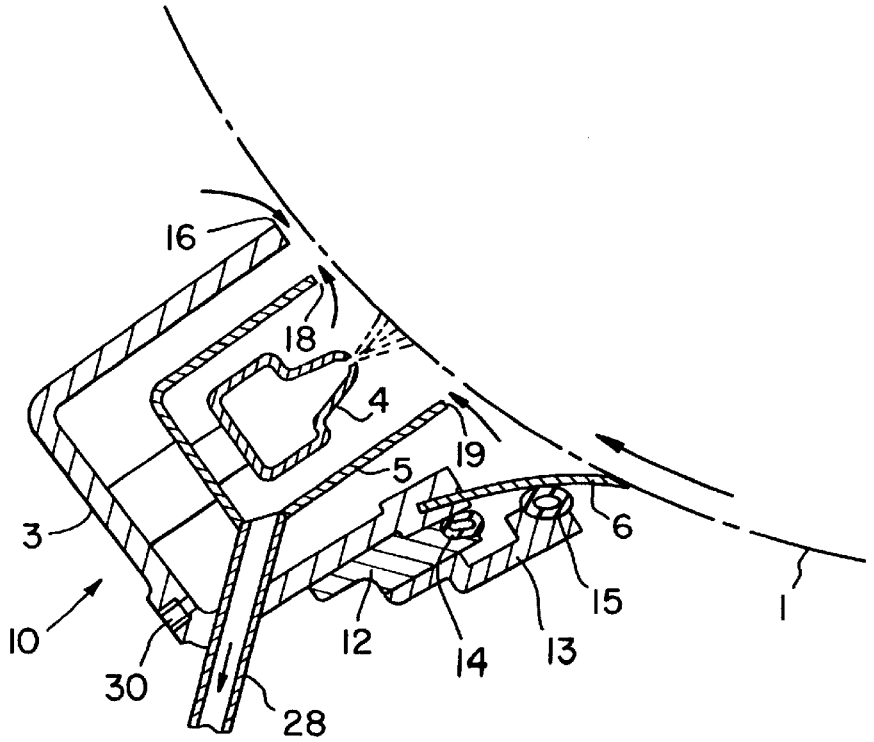
FIG. 2, a detail of the inventional coating system.
Figure 3:
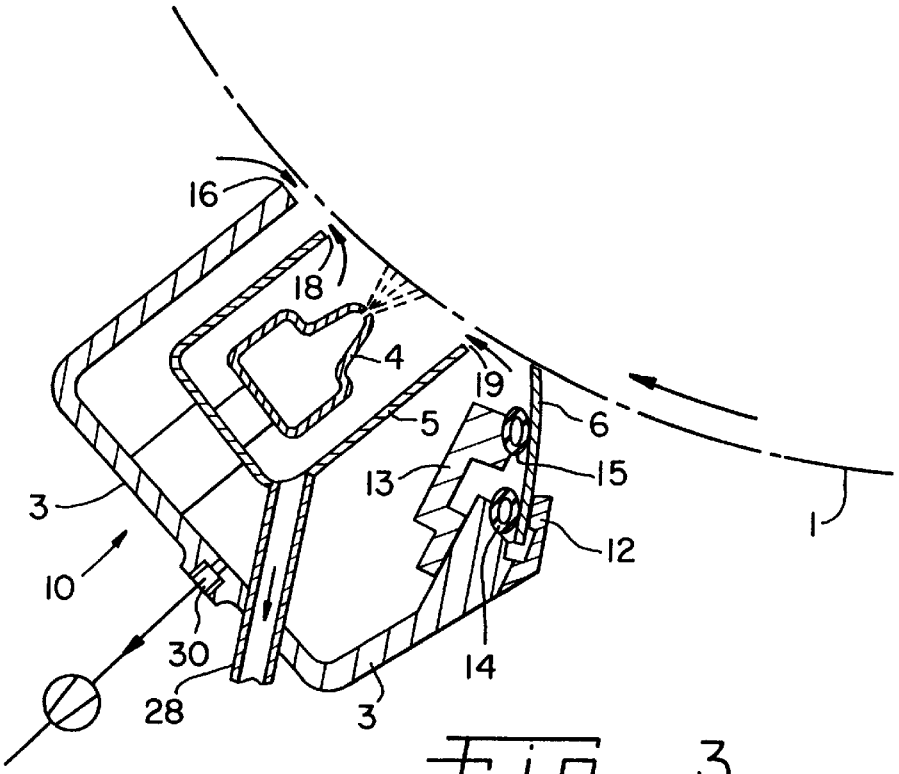
FIG. 3, a coating system with a different scraper arrangement.
Figure 4:
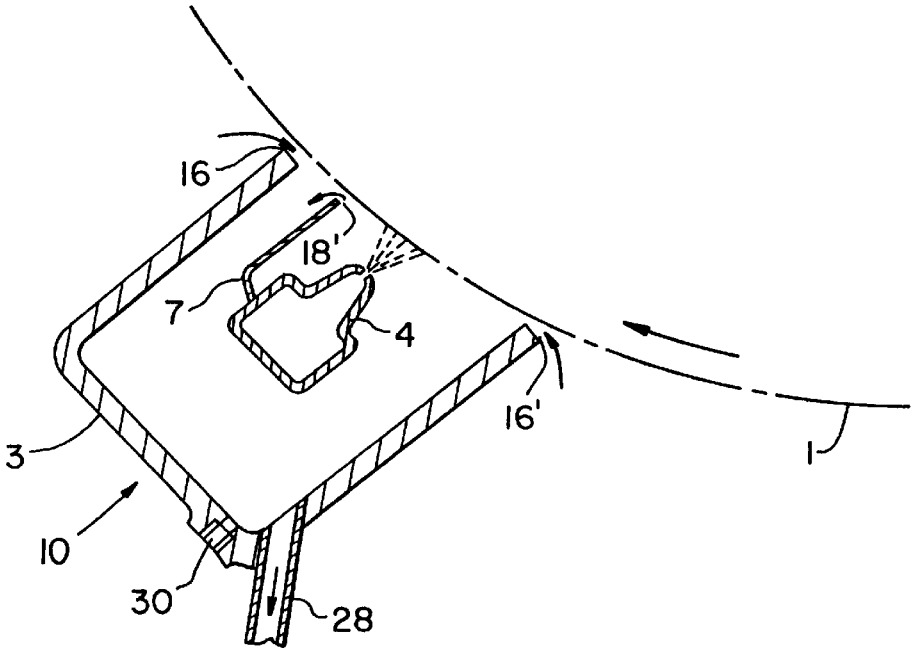
FIG. 4, the coating system with another variant of the inner chamber.

Applicators 10 can be seen from FIGS. 2, 3 and 4, and feature essentially a spray nozzle 4. As described already, the applicator sprays thin, misty jets of coating mixture on the shell surface of the press roll. As follows from FIG. 4, spray nozzle 4 is arranged in chamber 5 and in a chamber 3 in which a vacuum prevails. On its departure and approach side, toward the surface of the pertaining press roll 1 or 2 (FIG. 4 illustrating only applicator, or press roll 1), chamber 3 is sealed leaving a gap 16, 16', i.e., the coating mixture discharging from the spray nozzle 4 is at this point held back and thus prevented from escaping to the surroundings.

FIG. 4 shows a preferred embodiment of the invention. A side wall 7 is arranged in the chamber 3 on the departure side, spaced slightly from spray nozzle 4. Side wall 7 acts act as a baffle for part of the surplus spray mist which through gap 18' is sucked into vacuum chamber 3 and from there can be fed, via an exhaust 30 (for example a suction blower) to a separator not illustrated in the drawing. Coating mixture that has settled on the inside walls of chamber 3 and runs off empties through a drain 28 and can be merged with the mixture isolated in the separator, and thus made available for recycling.

In another embodiment, as illustrated in FIG. 2 and 3, the spray nozzle 4 is arranged within an inner chamber 5 whose interior—viewed in the direction of travel of the shell surface of the roll—is bounded by gaps 18 and 19. This interior chamber 5 is arranged within the outer chamber 3, with a vacuum prevailing in chamber 3 relative to the atmosphere, which vacuum may range, e.g., between 50 and 300 MPa.

As can be seen from the variants according to FIGS. 1 through 3, a scraper 6 may be provided on the approach side of chamber 3, as a seal for it. The scraper is retained in a holder 12 by means of a pressure hose 14, which forces the scraper on the back wall of the vacuum chamber 3.

A further pressure hose 15 is arranged in a holder 13 and pushes the scraper on the shell surface of the roll 1 at a variable, adjustable contact pressure. This contact pressure can also be kept constant by means of pressure hose 15.

Scraper 6 in FIG. 2 is fashioned as a so-called chisel scraper, which is used on rolls with a hard surface. It is called a chisel scraper because of its inclination opposite to the running direction of press roll 1 or 2.

In FIG. 3, the scraper is fashioned as a so-called drag scraper, its name deriving from the fact that is drags on the roll. It is used on rolls with a soft surface.

The sizing transferring from the roll surface to the web—as far as irregularities are still present in the layer—is further and very heavily smoothed by the roll nip. Extremely low coating weights, between 0.3 and 0.8 g/m$^2$ based on dry substance, are achieved thereby. This is a very small amount of coating, which with conventional devices such as disclosed in EP 03 35 904 B1, cannot be applied with the necessary uniformity, all the more so as with this solution the coating mixture is applied directly on the material web.

Owing to the design of the applicator as a spray system, it is not absolutely necessary to arrange it beneath the press rolls, but it may spray also onto the upper parts of their shell surface. The web travel and the direction of rotation of the rolls are then preferably opposite, as illustrated in FIG. 1.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for coating a web with a coating mixture, comprising the steps of:

providing a roll having a shell surface, said shell surface including a portion thereof which is adapted for contacting the web;

providing an applicator system having a vacuum chamber, an inner chamber and a spray nozzle, said spray nozzle disposed within said inner chamber and said inner chamber disposed within said vacuum chamber, said inner chamber including a positive pressure therein and said vacuum chamber including a vacuum therein, said spray nozzle producing a spray mist of the coating mixture;

directing the spray mist toward and applying the coating mixture to said shell surface; and transferring the coating mixture from the shell surface to the web.

2. In a machine for making or processing a web, a system for coating the web with a coating mixture, said system comprising:

a roll having a shell surface, said shell surface including a portion thereof which is adapted for contacting the web; and an applicator system for applying the coating mixture to said shell surface, said applicator system including a vacuum chamber, an inner chamber and a spray nozzle, said spray nozzle disposed within said inner chamber and said inner chamber disposed within said vacuum chamber, said inner chamber including a positive pressure therein and said vacuum chamber including a vacuum therein, said spray nozzle producing a spray mist of the coating mixture which is directed toward and applied to said shell surface, wherein said shell surface is structured and arranged to transfer the coating mixture to the web.

3. The system of claim 2, further comprising a side wall disposed with said vacuum chamber, said side wall acting as a baffle and defining said inner chamber.

4. The system of claim 2, wherein said vacuum chamber is defined in part by said shell surface.

5. The system of claim 3, wherein said vacuum chamber further defines an outer chamber about said inner chamber, and further comprising a drain for removal of accumulated coating mixture, said drain disposed in communication with said inner chamber and extending through said outer chamber.

6. The system of claim 2, wherein said vacuum chamber is defined in part by said shell surface.

7. The system of claim 2, further comprising a scraper attached to said vacuum chamber for sealing between said vacuum chamber and said shell surface.

8. The system of claim 7, wherein said vacuum chamber has an approach side and a departure side relative to a direction of travel of said roll, said scraper being disposed on said approach side of said vacuum chamber.

9. The system of claim 8, wherein said scraper is configured as a chisel scraper disposed at an acute angle relative to said shell surface of said roll.

10. The system of claim 8, wherein said scraper is configured as a drag scraper disposed at an acute angle relative to said shell surface of said roll.

11. The system of claim 2, further comprising a drain in communication with said vacuum chamber for removal of accumulated coating mixture therein.

12. The system of claim 2, wherein the coating mixture consists essentially of sizing which is applied to the web at a coating weight ranging between 0.3 to 0.8 $g/m^2$, based on a dry weight of said sizing.

13. The system of claim 12, further comprising a second roll and a second applicator system associated with said second roll, said coating mixture being applied to both sides of the web.

14. The system of claim 2, further comprising a second roll and a second applicator system associated with said second roll, said second roll including a second shell surface including a portion thereof which is adapted for contacting the web, each of said shell surface and said second shell surface being structured and arranged to transfer the coating mixture to both sides of the web, respectively.

15. The system of claim 2, wherein said vacuum chamber is operable within a pressure range between 50 MPa to 300 MPa.

* * * * *

UNITED STATES PATENT AND TRADEMARK OFFICE

CERTIFICATE OF CORRECTION

PATENT NO. : 6,203,858 B1
DATED : March 20, 2001
INVENTOR(S) : Anton Plomer

It is certified that error appears in the above-identified patent and that said Letters Patent is hereby corrected as shown below:

Column 3,
Line 15, after "arranged in" insert -- a --; and after "5" insert -- , -- therefor.

Column 4,
Line 61, delete "2" and substitute -- 3 -- therefor.

Signed and Sealed this

Twentieth Day of November, 2001

*Attest:*

Nicholas P. Godici

*Attesting Officer*

NICHOLAS P. GODICI
*Acting Director of the United States Patent and Trademark Office*